US005887639A

United States Patent [19]

Uzaki et al.

[11] Patent Number: 5,887,639

[45] Date of Patent: Mar. 30, 1999

[54] METHOD AND APPARATUS FOR MANUFACTURING GAS-HARDENED MOLDS

[75] Inventors: Nagato Uzaki, Toyohashi; Masayoshi Kasazaki; Hisashi Harada, both of Hoi-gun; Kazuo Sugimoto, Toyokawa, all of Japan

[73] Assignee: Sintokogio, LTD., Nagoya, Japan

[21] Appl. No.: 734,860

[22] Filed: Oct. 23, 1996

[30] Foreign Application Priority Data

Oct. 27, 1995 [JP] Japan ..... 7-303836

[51] Int. Cl.[6] ..... B22C 15/23; B22C 15/272; B22C 15/276

[52] U.S. Cl. ..... 164/16; 164/37; 164/169

[58] Field of Search ..... 164/37, 38, 15, 164/16, 159, 169, 7.1

[56] References Cited

U.S. PATENT DOCUMENTS 5,558,148 9/1996 Uzaki et al. ..... 164/38

FOREIGN PATENT DOCUMENTS 55-139141 10/1980 Japan ..... 164/16

*Primary Examiner*—Kuang Y. Lin

*Attorney, Agent, or Firm*—Limbach & Limbach L.L.P.

[57] ABSTRACT

A method and apparatus is provided for increasing the packing density and strength of sand for gas-hardening casting molds. The method is characterized by the steps of filling spaces defined by a pattern plate 1 and a mold frame with gas-hardening casting sand 4, depressurizing a closed container 3 after the filled assembly has been conveyed thereinto, introducing air into the container 3, applying a pressure to the upper surface of the casting sand to increase its packing density, and hardening the casting sand by a hardening gas.

3 Claims, 1 Drawing Sheet

METHOD AND APPARATUS FOR MANUFACTURING GAS-HARDENED MOLDS

BACKGROUND OF THE INVENTION

1. Field of the Invention

This invention relates to a method and apparatus for manufacturing a casting mold by gas-hardening casting sand.

2. Prior Art

To date various methods of manufacturing a casting mold by gas-hardening casting sand have been widely used. To reduce the amount of gas used, and to increase the resistance to the breakdown of a casting mold, a method of manufacturing a type of gas-hardened casting mold (the VRH method) is also well-known. This method is comprised of the steps of putting a casting mold, molded with gas-hardening sand, into a closed container; producing a vacuum in the container; and filling spaces between the particles of the casting sand in the casting mold with hardening gas to harden the casting mold to a given level of strength.

However, the conventional method has a problem in that the flowability of gas-hardening casting sand is inferior so that its packing density at the time of molding is relatively low. No attempt to increase the packing density to solve this problem was satisactory, but filling and compacting the mold takes a lot of time. In the carbon-dioxide mold method, among others, a reduction of time in packing the mold has been wanted, because the flowability of the casting sand is inferior due to the high coefficient of viscosity of water glass used as a caking additive, and because the packing is mostly done manually.

Considering above problems this invention has been made to provide a method and apparatus that can easily give a high packing density to sand for forming a gas-hardened casting mold and to increase the strength of the mold.

SUMMARY OF THE INVENTION

To achieve the above purpose, the method of manufacturing a gas-hardened casting mold of this invention is characterized by the steps of filling with gas-hardening casting sand a space that is defined by a pattern plate 1 accompanied by a model P, and a mold frame, placing a unit comprising the pattern plate, the mold frame, and casting sand in a closable container, closing the container, and depressurizing the closed container so as to reduce the pressure inside the container to 2–100 torr, introducing air into the depressurized container at a rate of 50–600 kg/cm$^2$/sec and applying a pressure to the upper surface of the sand to increase the packing density thereof, and hardening the casting sand by a hardening gas.

Further, to achieve the above purpose, the apparatus for manufacturing a gas-hardened casting mold of this invention is characterized by a closable container, into and from which an assembly comprising a pattern plate accompanied by a model, and a mold frame, can be conveyed, the space defined by the assembly being filled with gas-hardening casting sand, depressurizing means for discharging air from the inside of the container by a vacuum pump after it is closed, air-introducing means, disposed above the mold frame placed within the container, having a valve for introducing air, and means for introducing a hardening gas into the closed container.

DESCRIPTION OF THE PREFERRED EMBODIMENTS

Figure 1:
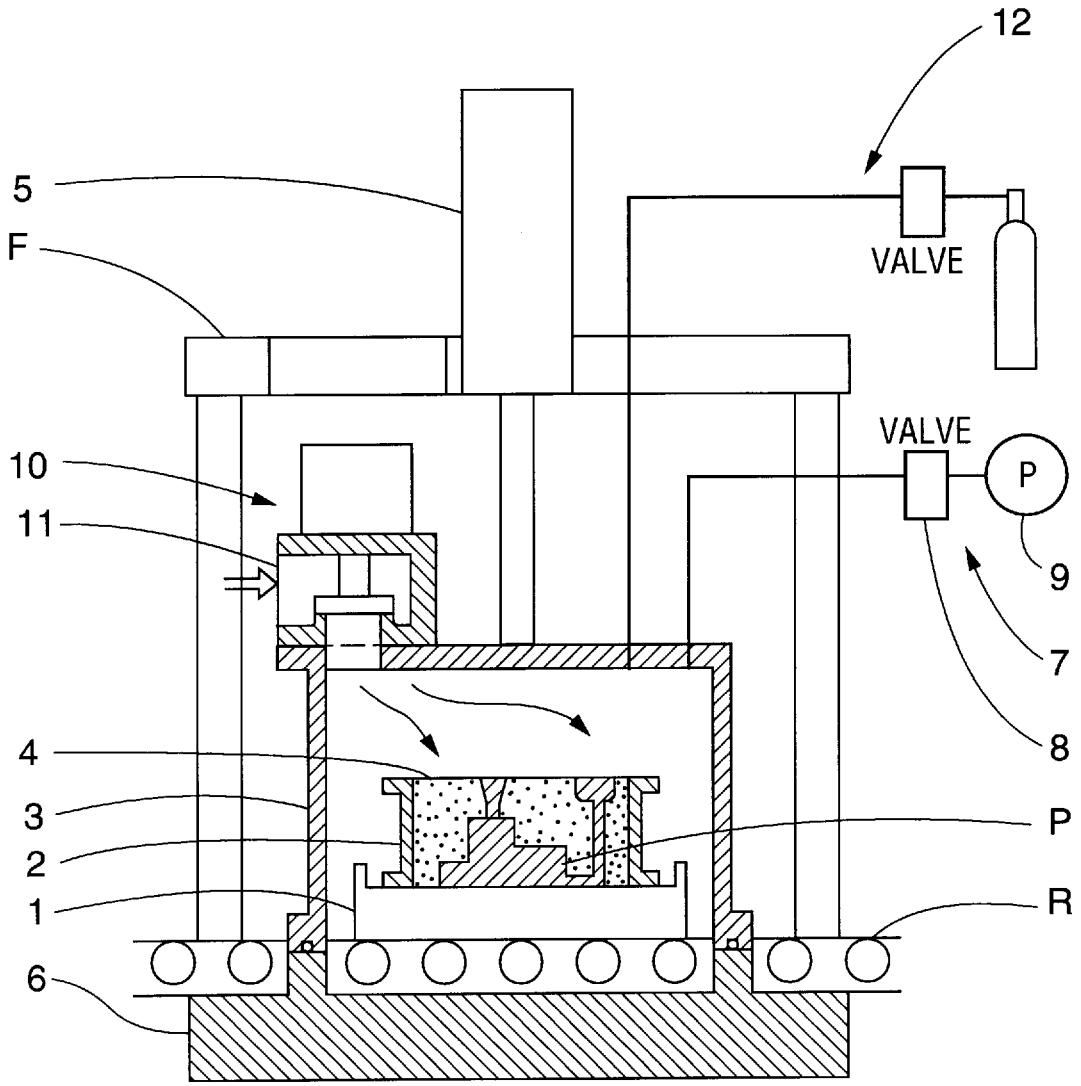
FIG. 1 is a schematic of an embodiment of this invention.

An embodiment of this invention will now be described by reference to the drawing: FIG. 1 is a schematic of the apparatus for manufacturing a gas-hardened casting mold of this invention. In FIG. 1 a mold frame 2 is mounted on upper parts of a pattern plate 1 accompanied by a model P, forming a unit. While this unit is outside of a closable container 3, the space defined by the pattern plate 1, model P, and mold frame 2 is filled with gas-hardening casting sand 4, and thereby forms an assembly as a unit. The assembly is then conveyed into the container 3, which is then closed. The container 3 consists of top and closed sides, but its bottom is open.

A frame F is provided above the container 3, on which frame F an elevating cylinder 5 is mounted. The cylinder 5 is coupled to the container 3 such that the container 3 can be driven by the cylinder 5 so as to be raised apart from or pressed against the base stand 6, to hermetically seal the container 3. The base stand 6 is provided with a roller conveyer R at its upper part so that when the container is raised the assembly can be conveyed on the roller into position in the container 3.

The container 3 is also equipped with depressurizing means 7, one end of which communicates with an upper part of the container 3, and the other end of which communicates with a vacuum pump 9 via a vacuum valve 8. The closed container 3 can be depressurized to 2–100 torr by the vacuum pump 9 by the operation of the vacuum valve 8.

Means 10 for introducing the atmosphere is provided in a unit at an upper part of the container 3. The atmosphere-introducing means 10, equipped with a valve 11, can introduce the atmosphere into the container 3 when it is closed. Means 12 for introducing a hardening gas is also provided at an upper part of the container 3 so as to communicate therewith.

The operation of the thus-structured apparatus will now be described: In FIG. 1 the space defined by the pattern plate 1, accompanied by the model P, and the casting frame 2, are manually filled with casting sand 4 in a place outside of the container 3, not shown. The filled assembly as a combined unit is then conveyed into the space to be closed by the container 3 by being moved on the roller conveyor R, while the container 3 is in a raised position. The container 3 is closed by being lowered and is pressed against the base stand 6 by the operation of the cylinder 5. The container is then depressurized to 2–100 torr by the operation of the vacuum valve 8 in a hermetically sealed condition.

Next, the atmosphere is instantaneously introduced into the closed container 3 by operating the valve 11 of the atmosphere-introducing means 10 provided at the upper part of the container 3. The atmosphere instantly affects the upper surface of the casting sand 4 as an impulsive pressure so that the casting sand 4 is compressed by the pressing force of the air.

When the sand is not sufficiently packed in one operation, these depressurizing and atmosphere-introducing processes can be repeated. The packing density of the casting sand 4 is further increased by the effect of the impulsive pressure.

Thereafter, the closed container 3 is again depressurized in a similar way as stated above. Then, a hardening gas is introduced into the closed container 3 by the hardening gas introducing means 12. The casting sand 4 is hardened by the penetration of the hardening gas into the inside thereof. Since the packing density has increased by the effect of the impulsive pressure, a casting mold with a higher strength can be obtained compared with a conventional one. The hardening gas may be introduced into the closed container 3 without depressurizing it. Further, hardening by a hardening gas may be carried out anywhere other than in the closed container.

For this invention gas-hardening casting sand 4 containing caking additives, such as water glass, a phenolic resin, urethane resin, or furan resin, is preferably used. A hardening gas, such as carbon dioxide, TEA gas, sulfur dioxide, and methyl formate, is selected depending on the type of the casting sand 4.

The depressurizing means 7 that communicates with the closed container 3 at its upper part is shown in the above embodiment, but the depressurizing means 7 may communicate with the closed container at any other part thereof.

The rate at which the atmosphere increases is preferably 50–600 kg/cm$^2$/sec, or is more preferably 200–400 kg/cm$^2$/sec. The air to be introduced may be pressurized air, and if so, a maximum pressure of 10 kg/cm$^2$ is preferable. The pressure may be optimized per the shape and size of the atmosphere-introducing valve 11.

In the above-mentioned embodiment of this invention the atmosphere-introducing means 10 is provided at its upper part. However, any number of the means 10 can be provided at any place, provided that they are located above the casting frame 2.

Further, in the above-mentioned embodiment of this invention the container 3 is elevated by the elevating cylinder 5. However, the container 3 may be structured such that it can be moved in the left or right direction or in a rotational direction, or in combined directions by adding an up and down direction thereto, provided that it can be hermetically sealed.

Further, in the above-mentioned embodiment of this invention the container 3 is moved down relative to the mold frame 2 and the like by the elevating cylinder 5, so as to hermetically press it against the base stand 6. However, the mold frame 2 and the like may be raised by placing them on an elevating table, while the container is fixed in position, thereby closing the container.

From the above descriptions clearly this invention has significant effects for the industry in that it can easily and quickly give a high packing density to sand for forming a gas-hardened mold with a high strength, especially by applying air to the surface of the sand filling a mold assembly placed in the depressurized container to give an impulsive pressure to the sand so as to instantly compress it.

What is claimed is:

1. A method of manufacturing a gas-hardened mold comprising the steps of (a) filling with gas-hardenable casting sand a space that is defined by a pattern plate accompanied by a model, and a mold frame, (b) placing a unit comprising the pattern plate, the mold frame, and the casting sand in a closable container, closing the container, and depressurizing the closed container so as to reduce the pressure inside the container to 2–100 torr, (c) introducing air into the depressurized container at a rate of 50–600 kg/cm$^2$/sec thereby applying a pressure to the upper surface of the sand to increase the packing density thereof, (d) after step (c), again depressurizing the closed container so as to reduce the pressure inside the container to 2–100 torr, (e) after step (d), again introducing air into the depressurized container at the rate of 50–600 kg/cm$^2$/sec, thereby applying pressure to the upper surface of the sand to increase further the packing density thereof, and (f) after step (e), hardening the sand by exposing said sand to a hardening gas.

2. A method of claim 1, wherein the air introduced during step (c) is air at atmospheric pressure.

3. A method of claim 1, wherein the air introduced during step (c) is pressurized air.

* * * * *